US011852130B2

(12) United States Patent
Yoshii et al.

(10) Patent No.: US 11,852,130 B2
(45) Date of Patent: Dec. 26, 2023

(54) PUMP SYSTEM WITH VIBRATION GENERATION AND SUPPRESSION MODE IN A WEARABLE ELECTRONICS DEVICE

(71) Applicant: MINEBEA MITSUMI INC., Nagano (JP)

(72) Inventors: Yuta Yoshii, Tokyo (JP); Chikara Sekiguchi, Tokyo (JP); Shigenori Inamoto, Tokyo (JP); Yuki Takahashi, Tokyo (JP); Daisuke Kodama, Tokyo (JP); Kenta Ueda, Tokyo (JP); Takahiko Irie, Tokyo (JP); Daisuke Kurita, Nagano (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 17/656,192

(22) Filed: Mar. 23, 2022

(65) Prior Publication Data

US 2022/0316468 A1 Oct. 6, 2022

(30) Foreign Application Priority Data

Mar. 30, 2021 (JP) ..... 2021-58521

(51) Int. Cl.
*F04B 49/00* (2006.01)
*F04B 43/04* (2006.01)

(52) U.S. Cl.
CPC ..... *F04B 49/00* (2013.01); *F04B 43/043* (2013.01)

(58) Field of Classification Search
None
See application file for complete search history.

(56) References Cited

U.S. PATENT DOCUMENTS 3,824,852 A * 7/1974 Otto ..... F04B 17/042 134/1
5,707,215 A * 1/1998 Olney ..... B60C 23/133 417/328
5,941,692 A * 8/1999 Olney ..... H02K 35/06 417/328

(Continued)

FOREIGN PATENT DOCUMENTS

CN 113397791 A * 9/2021
CN 114601712 A * 6/2022

(Continued)

OTHER PUBLICATIONS

Machine translation of CN-114631990-A (Translation from USPTO Search, copyright Clarivate Analytics, 2023) (Year: 2023).*

(Continued)

*Primary Examiner* — Essama Omgba
*Assistant Examiner* — Geoffrey S Lee
(74) *Attorney, Agent, or Firm* — McCoy Russell LLP

(57) ABSTRACT

A pump system contains a pair of pumps each of which contains a vibration actuator vibrated by electromagnetic drive and can discharge fluid due to drive of the vibration actuator. The pump system has a vibration suppression mode in which the pair of the pumps are driven so that vibration of the vibration actuators of the pair of pumps is cancelled each other and a vibration generation mode in which the pair of the pumps are driven so that the vibration of the vibration actuators of the pair of pumps is superimposed with each other.

8 Claims, 12 Drawing Sheets

(56) References Cited

U.S. PATENT DOCUMENTS

| | | | | |
|---|---|---|---|---|
| 6,379,310 | B1 * | 4/2002 | Mori | A61B 5/742 600/490 |
| 9,814,859 | B2 * | 11/2017 | Onuma | B60W 50/16 |
| 11,298,032 | B2 * | 4/2022 | Mou | A61B 5/02241 |
| 2016/0226542 | A1 * | 8/2016 | Tran | A61B 5/14542 |
| 2018/0000685 | A1 * | 1/2018 | Maloney | A61N 1/0456 |
| 2019/0269914 | A1 * | 9/2019 | Moaddeb | A61N 1/36031 |
| 2020/0121258 | A1 * | 4/2020 | Zhu | A61B 5/02125 |
| 2020/0358346 | A1 * | 11/2020 | Delaisse | H02K 33/02 |
| 2021/0244300 | A1 * | 8/2021 | Nishida | A61B 5/02233 |
| 2021/0307626 | A1 * | 10/2021 | Ono | A61B 5/6824 |
| 2021/0307631 | A1 * | 10/2021 | Ono | A61B 5/6844 |
| 2022/0125327 | A1 * | 4/2022 | Ikeda | A61B 5/02141 |
| 2022/0316468 | A1 * | 10/2022 | Yoshii | F04B 49/00 |

FOREIGN PATENT DOCUMENTS

| | | | | |
|---|---|---|---|---|
| CN | 114631990 | A | * | 6/2022 |
| CN | 114732976 | A | * | 7/2022 |
| DE | 202014010280 | U1 | | 4/2015 |
| JP | S5139813 | U | | 3/1976 |
| JP | H0783171 | A | | 3/1995 |
| JP | 2004245119 | A | | 9/2004 |
| JP | 2020006344 | A | | 1/2020 |
| JP | 2020165410 | A | | 10/2020 |
| WO | WO-2020253729 | A1 | * | 12/2020 |
| WO | 2021200424 | A1 | | 10/2021 |

OTHER PUBLICATIONS

Machine translation of CN-113397791-A (Translation from USPTO Search, copyright Clarivate Analytics, 2023) (Year: 2023).*

Machine translation of CN-114601712-A (Translation from USPTO Search, copyright Clarivate Analytics, 2023) (Year: 2023).*

Machine translation of CN-114732976-A (Translation from USPTO Search, copyright Clarivate Analytics, 2023) (Year: 2023).*

Machine translation of WO-2020253729-A1 (Translation from USPTO Search, copyright Clarivate Analytics, 2023) (Year: 2023).*

European Patent Office, Extended European Search Report Issued in Application No. 22164404.0, dated Jul. 4, 2022, Germany, 8 pages.

* cited by examiner

PUMP SYSTEM WITH VIBRATION GENERATION AND SUPPRESSION MODE IN A WEARABLE ELECTRONICS DEVICE

CROSS-REFERENCE TO RELATED APPLICATION

The present application claims priority to Japanese Patent Application No. 2021-058521, filed on Mar. 30, 2021. The entire contents of the above-listed application are hereby incorporated by reference for all purposes.

TECHNICAL FIELD

The present disclosure relates to a pump system and an electronic device.

BACKGROUND

For example, patent document 1 discloses a structure which can reduce vibration of a motor for an electric pump.

RELATED ART DOCUMENT

Patent Document

Patent Document 1: JP 2020-165410A

SUMMARY

Problem to be Solved by the Disclosure

However, if the vibration of the motor for the electric pump is reduced, it becomes impossible to utilize the vibration of the motor in another application. For example, in a case of configuring a device in which a vibration generating unit such as a vibrator needs to be provided together with the electric pump, the vibration generating unit should be provided separately from the motor for the electric pump. This may result in increases of a size, complexity, a cost and the like of the device.

The present disclosure has been made in view of the above-described problem of the conventional art. Accordingly, it is an object of the present disclosure to provide a pump system which can utilize the vibration generated from the pump in another application and an electronic device utilizing the pump system.

Means for Solving the Problems

The above object is achieved by the present disclosures defined in the following (1) to (9).

(1) A pump system, comprising:

a pair of pumps, each of which contains a vibration actuator vibrated by electromagnetic drive and can discharge fluid due to drive of the vibration actuator, wherein the pump system has:

a vibration suppression mode in which the pair of the pumps are driven so that vibration of the vibration actuators of the pair of pumps is cancelled each other, and a vibration generation mode in which the pair of the pumps are driven so that the vibration of the vibration actuators of the pair of pumps is superimposed with each other.

(2) The pump system according to the above (1), wherein the pump system is configured to switch between the vibration suppression mode and the vibration generation mode by changing a phase difference between the vibration of the vibration actuator of one of the pair of pumps and the vibration of the vibration actuator of the other one of the pair of pumps.

(3) The pump system according to the above (2), wherein the pair of pumps are arranged so that vibration directions of the vibration actuators of the pair of pumps coincide with each other.

(4) The pump system according to the above (3), wherein the pair of pumps are respectively driven in opposite phases in the vibration suppression mode.

(5) The pump system according to the above (3) or (4), wherein the pair of the pumps are driven in-phase in the vibration generation mode.

(6) The pump system according to the above (5), wherein the vibration generation mode contains a plurality of modes whose phase differences are different from each other.

(7) An electronic device, comprising:

the pump system defined by any one of the above (1) to (6).

(8) The electronic device according to the above (7), wherein the electronic device is a wearable terminal including a supply target into which the fluid should be supplied from the pump system.

(9) The electronic device according to the above (8), wherein the electronic device has:

a pump drive mode for supplying the fluid into the supply target from the pump system, and a vibrator drive mode for vibrating the pump system without supplying the fluid into the supply target from the pump system.

Effect of the Disclosure

According to the pump system and the electronics device of the present disclosure, it is possible to generate vibration by driving the pair of pumps so that the vibration of the vibration actuators of the pair of pumps are superimposed with each other. Therefore, it is possible to utilize the vibration generated from the pump system in another application. Further, since the pump system has the vibration suppression mode in which the vibration is not generated and the vibration generation mode in which the vibration is generated and can switch between the vibration suppression mode and the vibration generation mode, it becomes possible to turn on or off the vibration while driving the pump system. Therefore, it is possible to generate the vibration only when the vibration is needed.

DETAILED DESCRIPTION

Hereinafter, a pump system and an electronic device of the present disclosure will be described in detail with reference to certain embodiments shown in the accompanying drawings.

Figure 1:
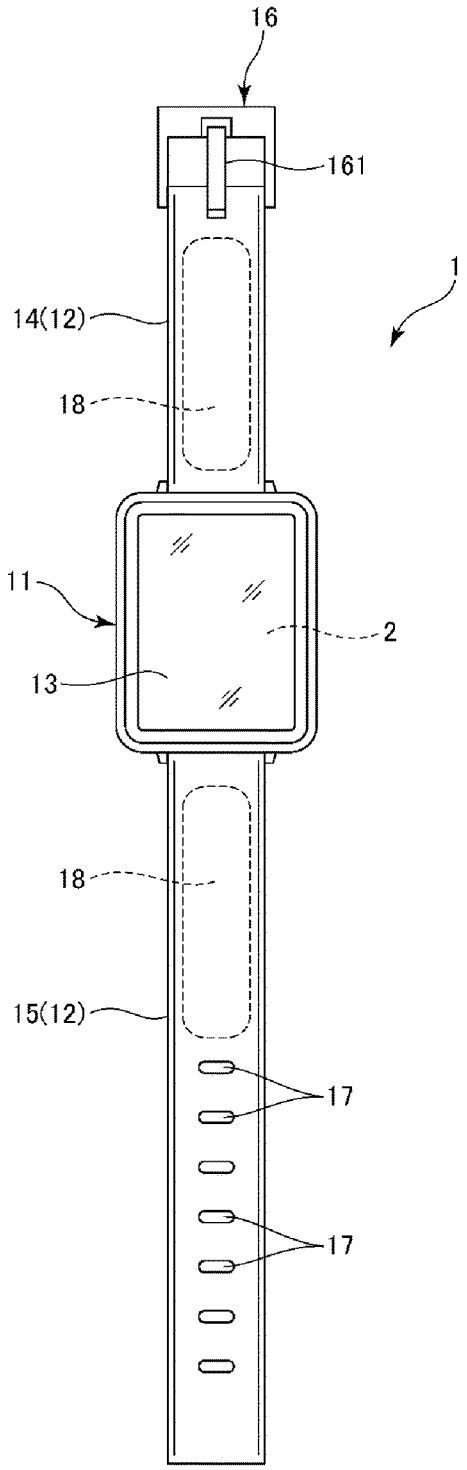
FIG. 1 is a plan view showing a smart watch according to an embodiment of the present disclosure.
Figure 2:
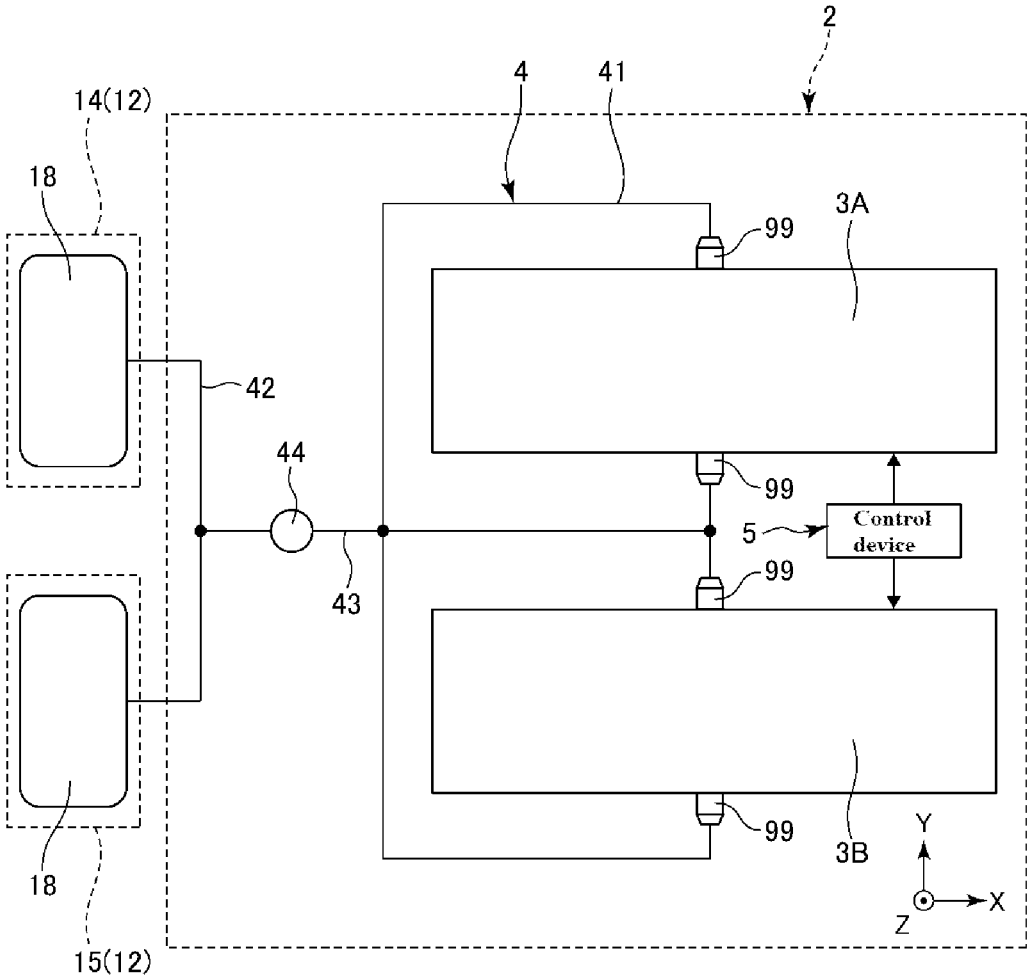
FIG. 2 is a diagram showing an overall configuration of a pump system applied to the smart watch.
Figure 3:
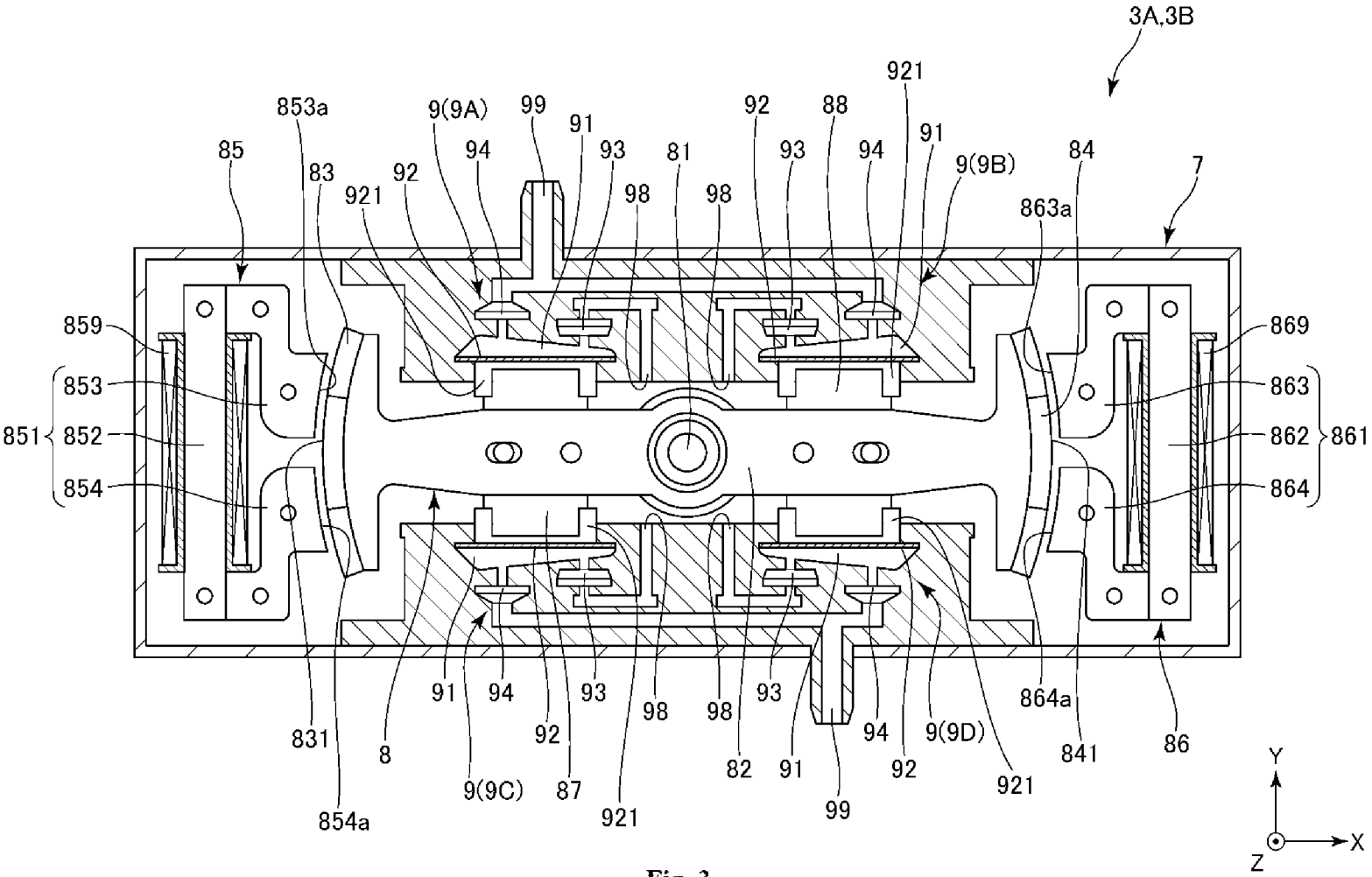
FIG. 3 is a cross-sectional view of a pump.
Figure 4:
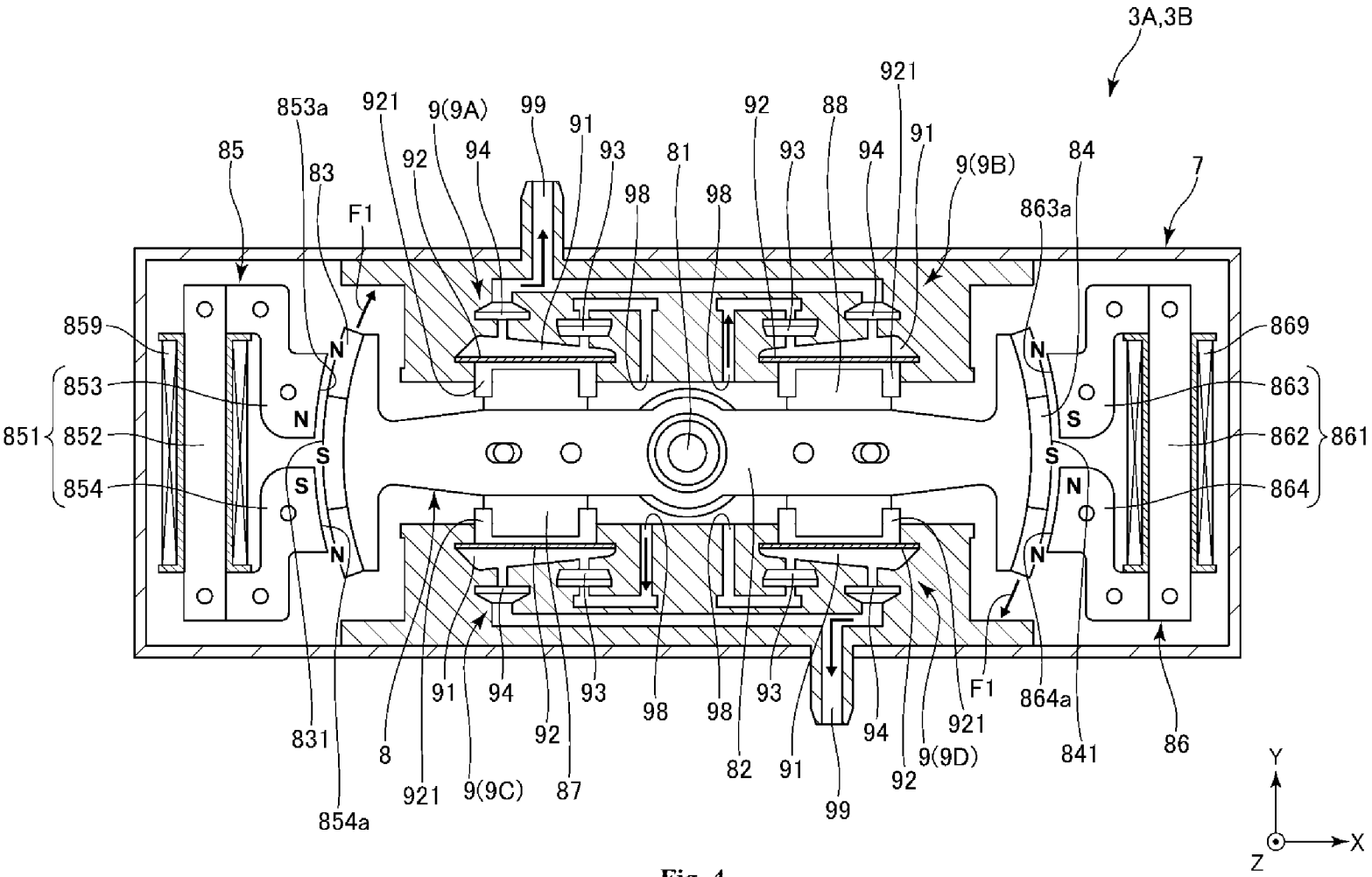
FIG. 4 is a cross-sectional view showing a driving principle of the pump shown in FIG. 3.
Figure 5:
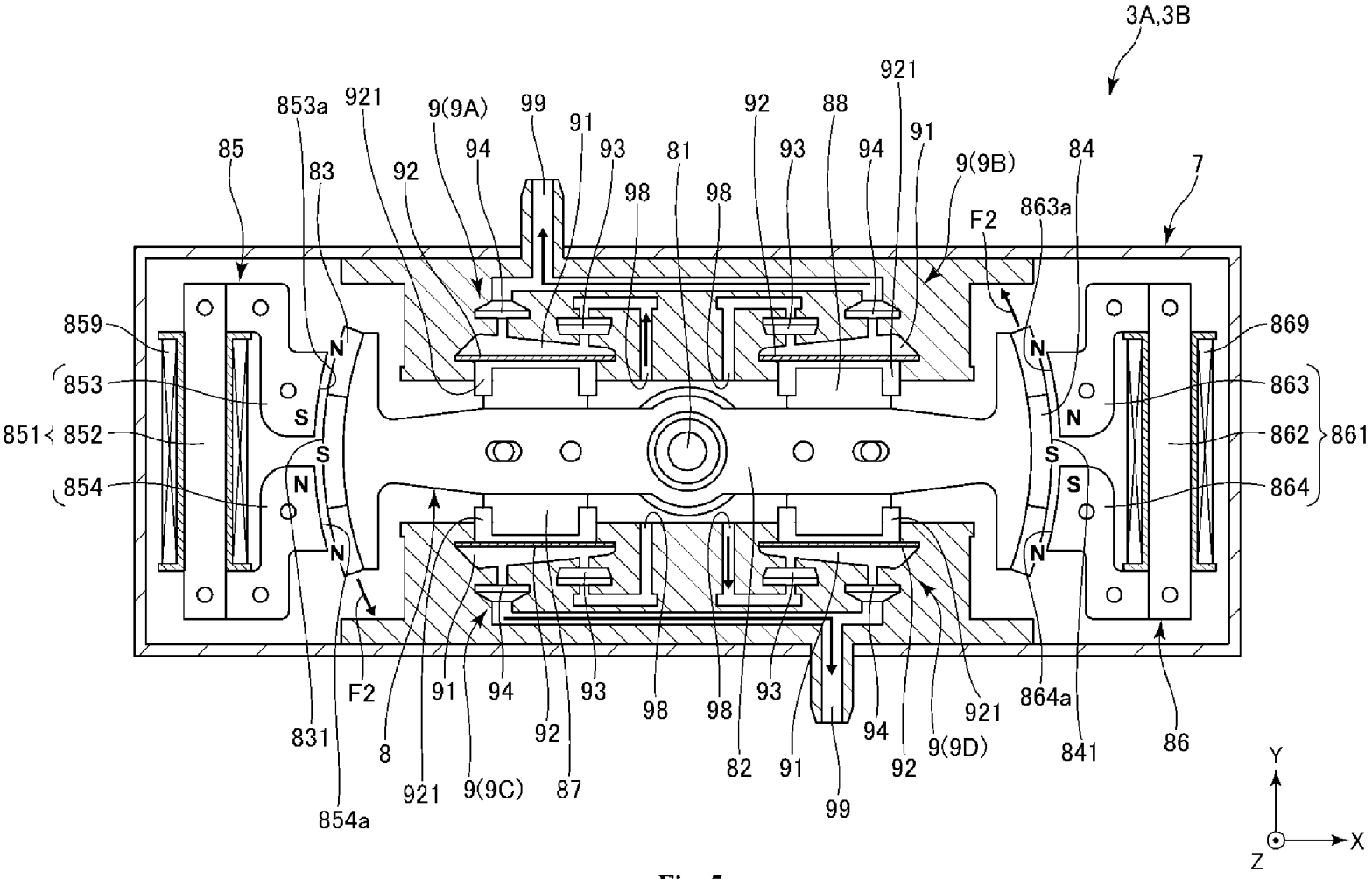
FIG. 5 is another cross-sectional view showing the driving principle of the pump shown in FIG. 3.
Figure 6:
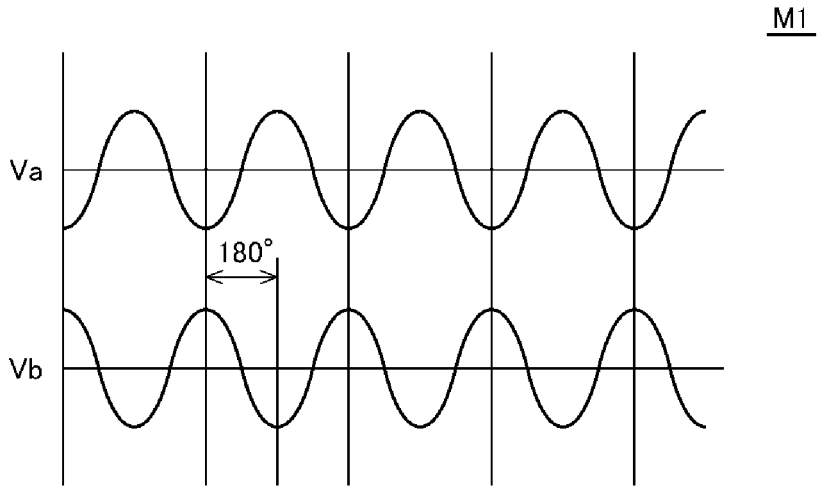
FIG. 6 is a diagram showing an AC voltage applied to the pump when the pump is in a vibration suppression mode.
Figure 7:
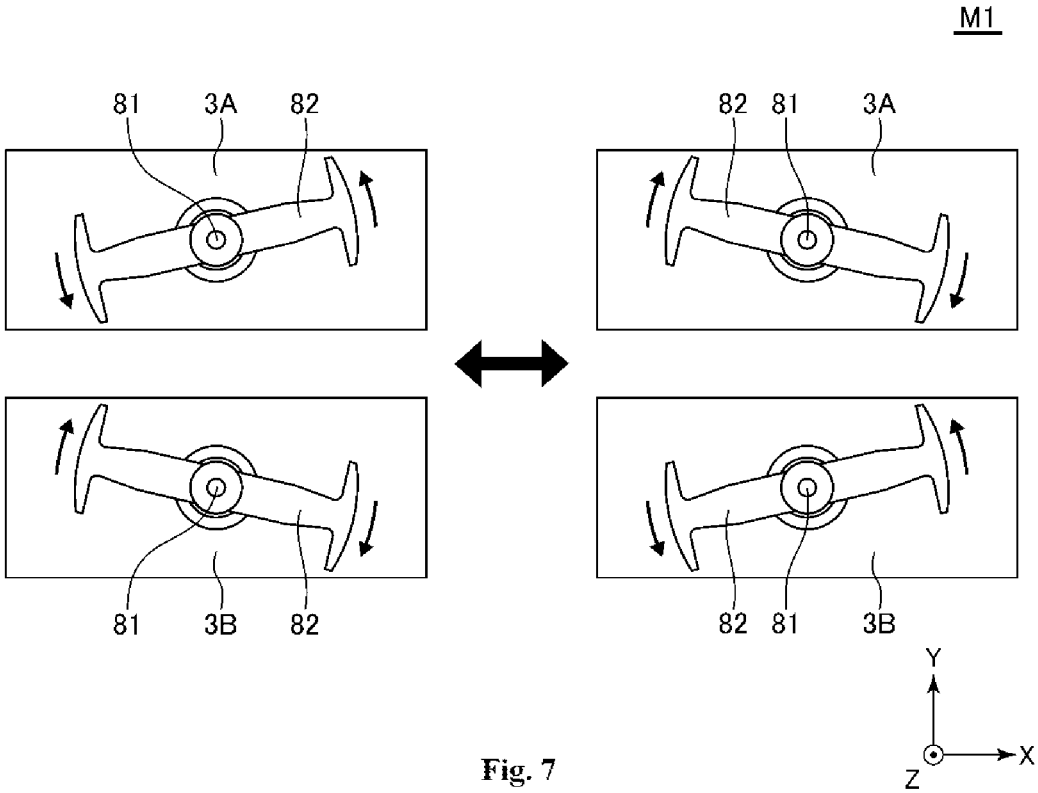
FIG. 7 is a diagram showing a driving state of each pump in the vibration suppression mode.
Figure 8:
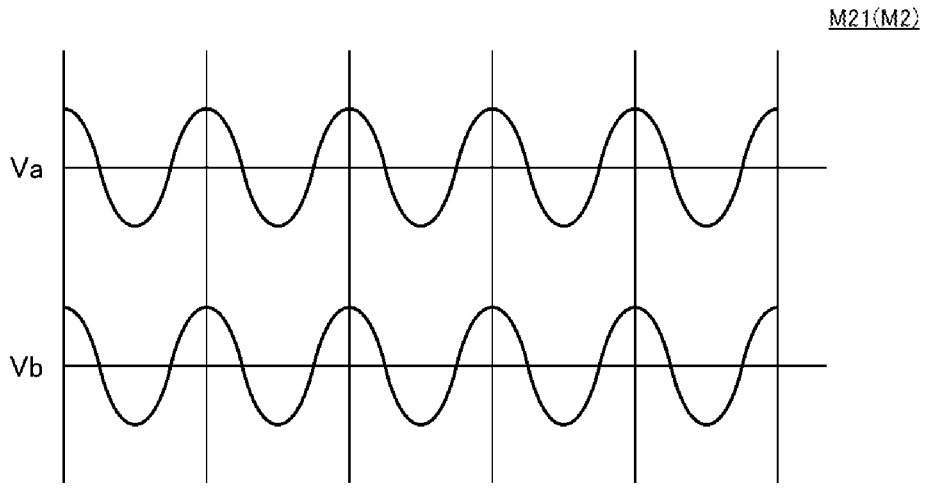
FIG. 8 is a diagram showing an AC voltage applied to the pump when the pump is in a first vibration generation mode.
Figure 9:
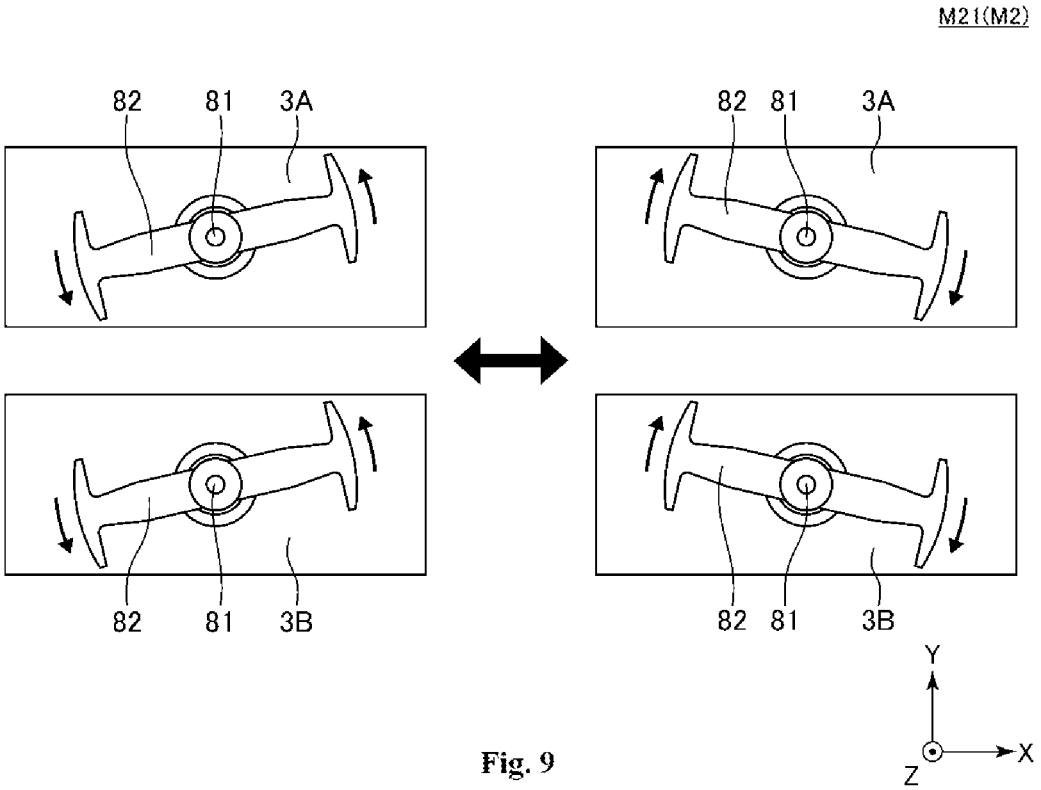
FIG. 9 is a diagram showing a driving state of each pump in the first vibration generation mode.
Figure 10:
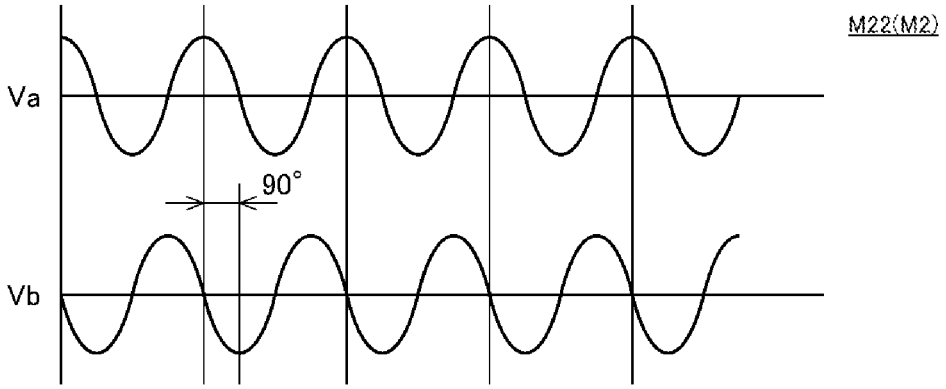
FIG. 10 is a diagram showing an AC voltage applied to the pump when the pump is in a second vibration generation mode.
Figure 11:
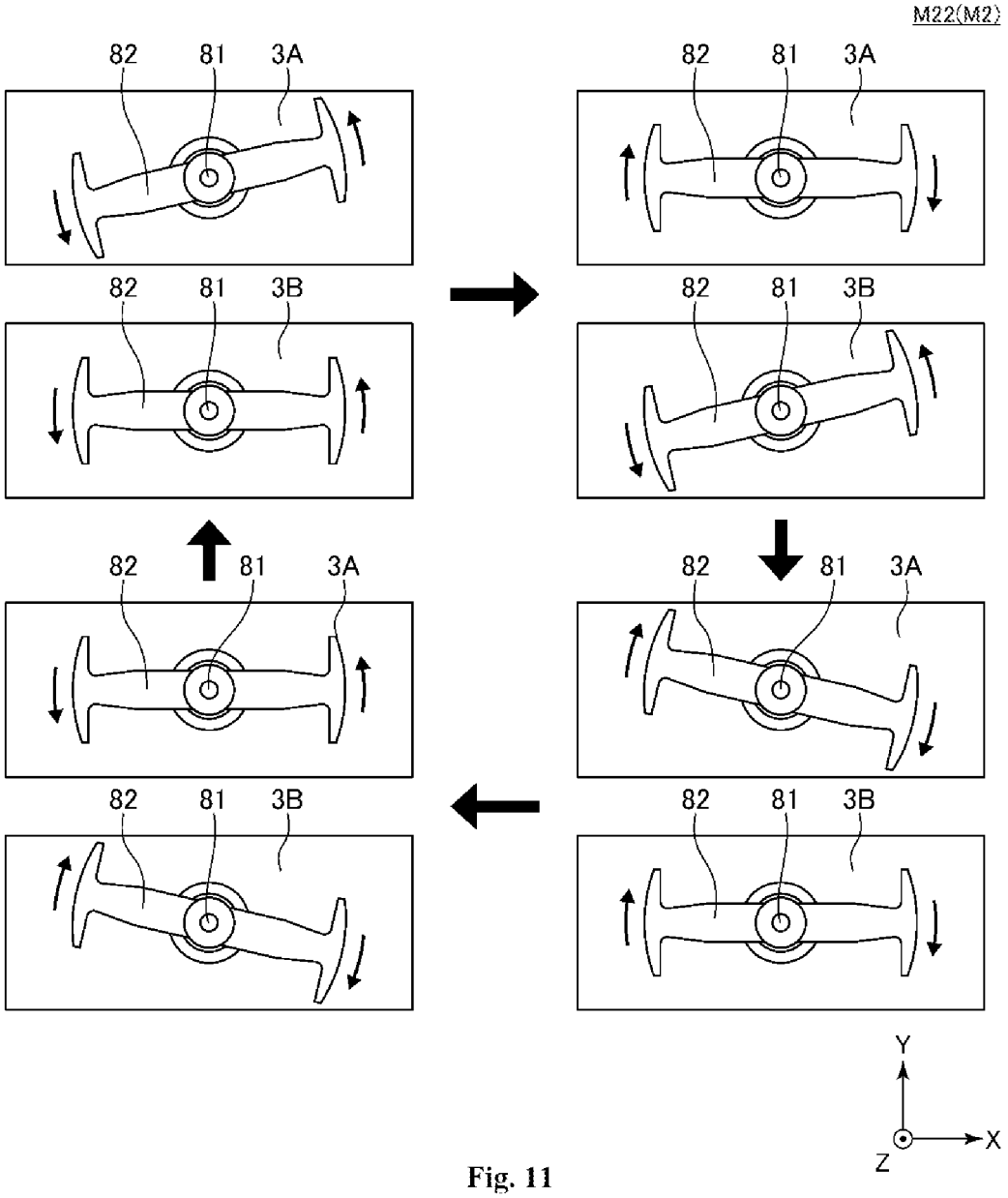
FIG. 11 is a diagram showing a driving state of each pump in the second vibration generation mode.
Figure 12:
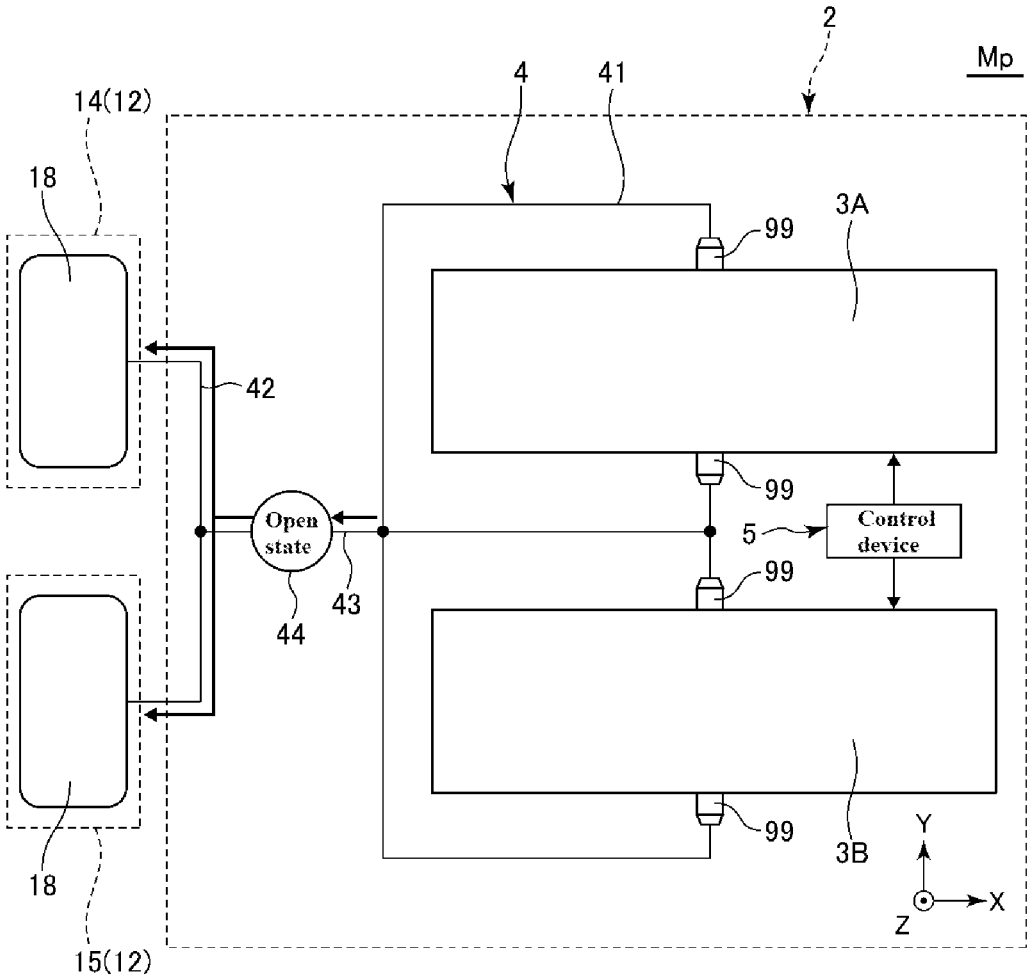
FIG. 12 is a diagram showing a state of a pump drive mode.
Figure 13:
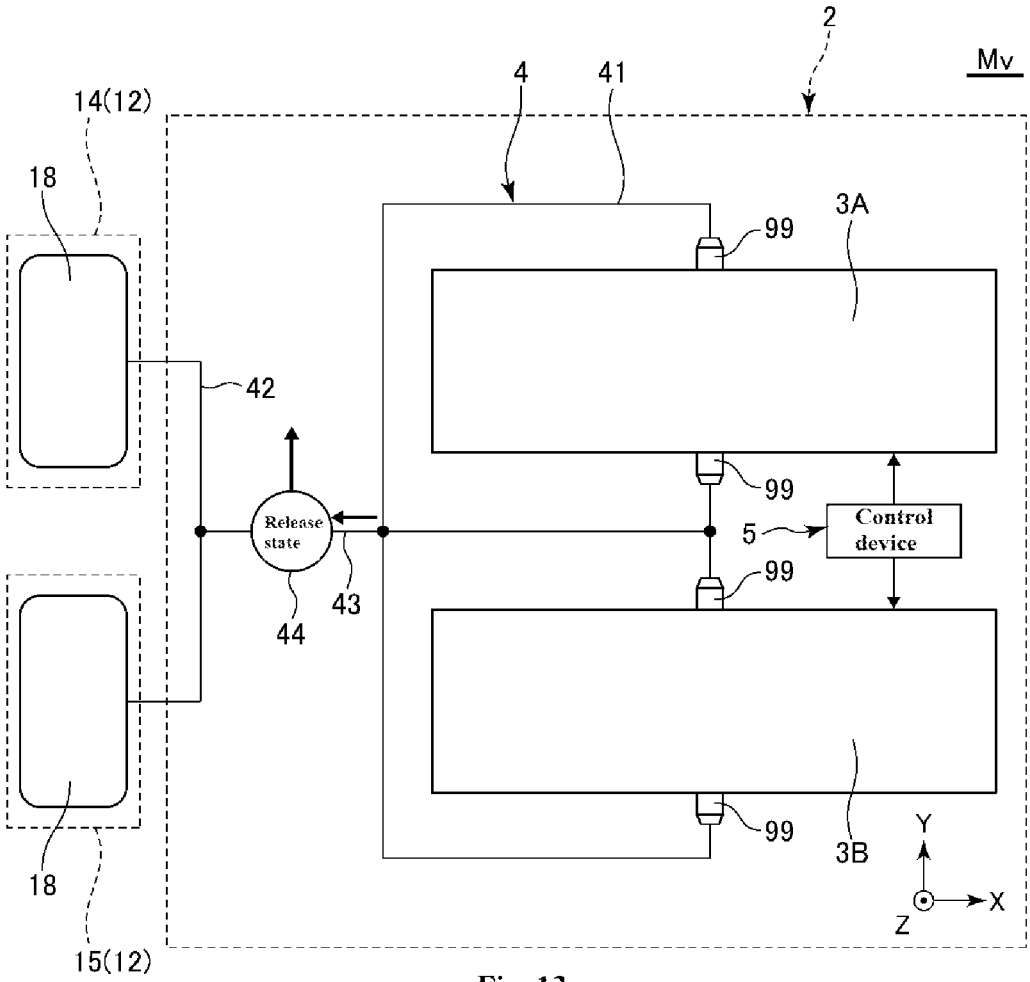
FIG. 13 is a diagram showing a state of a vibrator drive mode.
Figure 14:
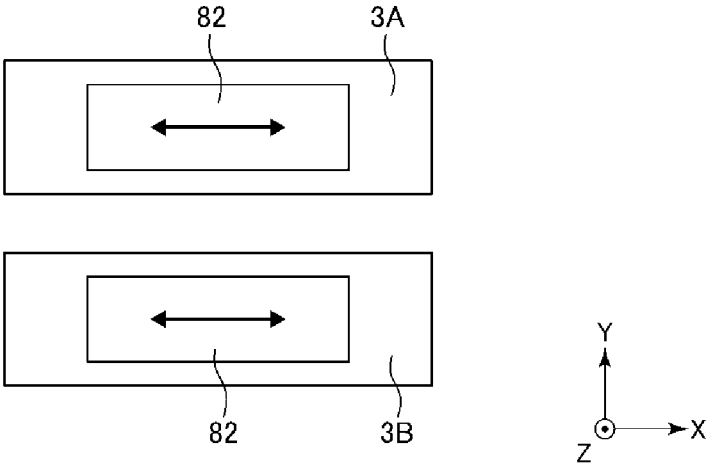
FIG. 14 is a diagram showing a modified example of the pump system.
Figure 15:
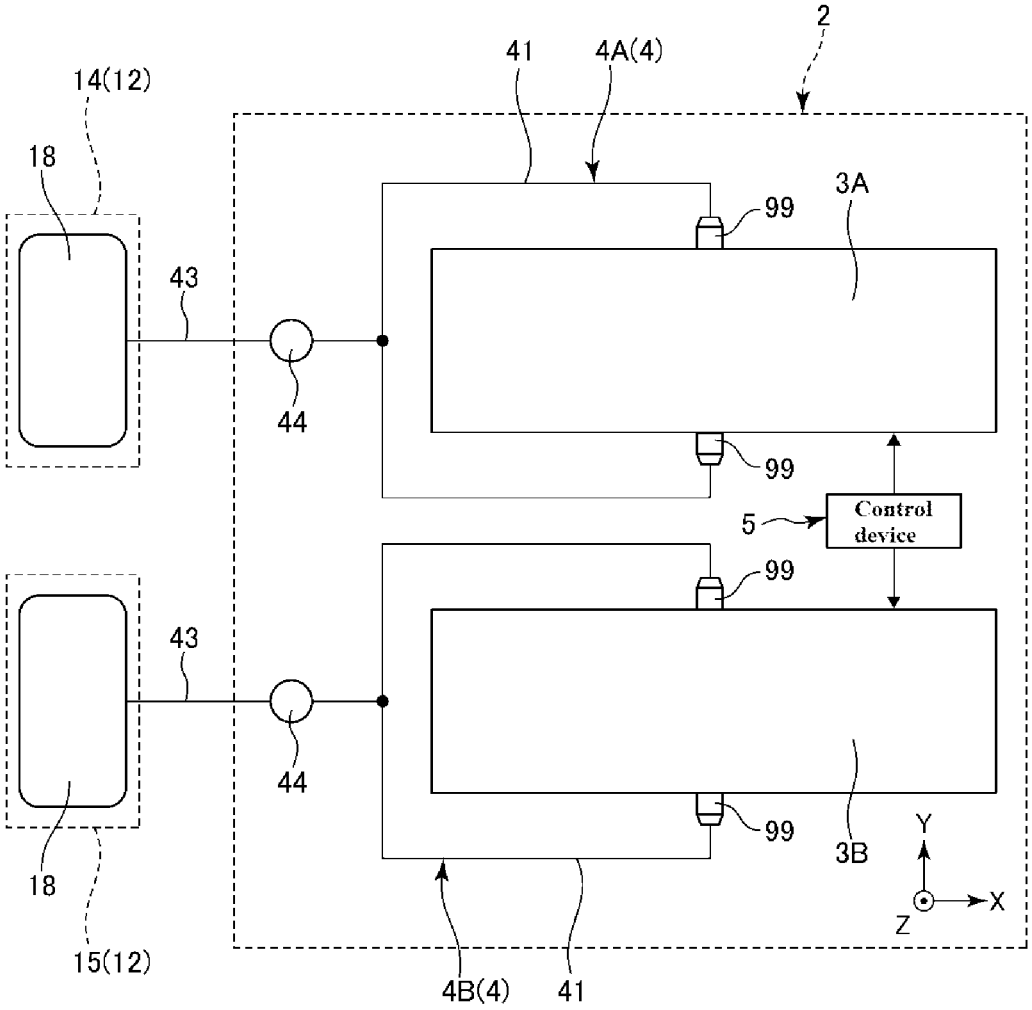
FIG. 15 is a diagram showing another modified example of the pump system.

FIG. 1 is a plan view showing a smart watch according to an embodiment of the present disclosure. FIG. 2 is a diagram showing an overall configuration of a pump system applied to the smart watch. FIG. 3 is a cross-sectional view of a pump. FIG. 4 is a cross-sectional view showing a driving principle of the pump shown in FIG. 3. FIG. 5 is another cross-sectional view showing the driving principle of the pump shown in FIG. 3. FIG. 6 is a diagram showing an AC voltage applied to the pump when the pump is in a vibration suppression mode. FIG. 7 is a diagram showing a driving state of each pump in the vibration suppression mode. FIG. 8 is a diagram showing an AC voltage applied to the pump when the pump is in a first vibration generation mode. FIG. 9 is a diagram showing a driving state of each pump in the first vibration generation mode. FIG. 10 is a diagram showing an AC voltage applied to the pump when the pump is in a second vibration generation mode. FIG. 11 is a diagram showing a driving state of each pump in the second vibration generation mode. FIG. 12 is a diagram showing a state of a pump drive mode. FIG. 13 is a diagram showing a state of a vibrator drive mode. FIGS. 14 and 15 are diagrams respectively showing modified examples of the pump system.

In the following description, it is noted that an X axis, a Y axis and a Z axis which are orthogonal to each other are illustrated in the drawings except for FIGS. 1, 6, 8 and 10 for convenience of explanation. Further, a direction along the X axis is also referred to as an X axis direction, a direction along the Y axis is also referred to as a Y axis direction and a direction along the Z axis direction is also referred to as a Z axis direction. A positive side (an arrowed side) in the Y axis direction is also referred to as "an upper side" and a negative side (an opposite side of the arrowed side) is also referred to as "a lower side".

An electronic device shown in FIG. 1 is a wearable terminal, more specifically, a smart watch 1. The smart watch 1 includes a watch body 11 in which a pump system 2 is provided and a belt 12 for attaching the watch body 11 to an arm of a user.

A touch panel type display 13 is provided on a surface of the watch body 11. Various information can be displayed on the display 13. The watch body 11 has a communication function such as Wi-Fi and Bluetooth and can cooperate with a smartphone or the like. Various applications can be installed in the watch body 11. For example, the smart watch 1 can use the various applications to provide various functions such as time confirmation, mail transmission/reception, voice communication, video communication, music player, electronic payment, blood pressure measurement, pedometer and game. Selection and execution of these applications are performed by touch input through the display 13.

The belt 12 has a buckle side belt 14 extending from one end (12 o'clock side end) of the watch body 11 and a blade tip side belt 15 extending from the other end (6 o'clock side end) of the watch body 11. A buckle 16 having a buckle tongue 161 is provided at a tip end portion of the buckle side belt 14. On the other hand, a plurality of small holes 17 into which the buckle tongue 161 can be inserted are formed in the blade tip side belt 15 along an extending direction of the blade tip side belt 15. The smart watch 1 can be attached to a wrist of the user by passing the blade tip side belt 15 through the buckle 16 and inserting the buckle tongue 161 into one of the small holes 17 corresponding to a size of the wrist of the user.

A bladder 18 (a supply target) into which fluid should be supplied from the pump system 2 is provided at each of the buckle side belt 14 and the blade tip side belt 15. Although the fluid is not particularly limited to a specific kind and may be liquid or gas, in some embodiments, the fluid is the gas. For convenience of explanation, the following description will be provided with assuming that the fluid is air.

In the present embodiment, the bladder 18 is embedded in each of the buckle side belt 14 and the blade tip side belt 15. However, the present disclosure is not limited thereto. For example, the bladder 18 may be provided on a rear surface or a front surface of each of the buckle side belt 14 and the blade tip side belt 15. The air is supplied into each of the bladders 18 from the pump system 2 to expand each of the bladders 18 in a state that the smart watch 1 is attached to the wrist of the user by using the buckle 16 as described above. As a result, the belt 12 can be closely contact with the wrist of the user, and thereby it is possible to improve a fitting feeling (a wear feeling) of the smart watch 1 to the wrist of the user.

Although the smart watch 1 has been briefly explained in the above description, the configuration of the smart watch 1 is not particularly limited. For example, the pump system 2 may be provided in the belt 12. Further, the watch body 11 may include at least one physical button in addition to the display 13.

The belt 12 is not particularly limited as long as it can be attached to the wrist of the user. For example, the belt 12 may be configured so that the buckle side belt 14 and the blade tip side belt 15 are coupled with each other by using a magnet or a hook and loop fastener instead of the buckle 16. In addition, the belt 12 may be configured so that the buckle side belt 14 and the blade tip side belt 15 are integrally formed, that is, the belt 12 has a ring shape connecting the 12 o'clock side end and the 6 o'clock side end of the watch body 11 and is attached to the wrist of the user only by expansion of the bladders 18.

Alternatively, the smart watch 1 may has a base to which the belt 12 is connected and the watch body 11 may be detachably attached to the base. In this case, the pump system 2 may be provided in the watch body 11 or may be provided in the base.

Next, the pump system 2 provided in the smart watch 1 will be described. As described above, the pump system 2 has the function of supplying the air into the bladders 18 to expand the bladders 18.

As shown in FIG. 2, the pump system 2 includes a pair of pumps 3A, 3B, a pipe line 4 connecting the pumps 3A, 3B and the bladders 18 and a control device 5 for controlling drive of each of the pumps 3A, 3B. Hereinafter, each of these components will be described in detail.

Pumps 3A, 3B

A configuration of the pump 3A is the same as a configuration of the pump 3B. Each of the pumps 3A, 3B includes a housing 7, a vibration actuator 8 and four pump units 9 as shown in FIG. 3.

The vibration actuator 8 includes a shaft portion 81, a movable body 82 supported by the shaft portion 81 so as to be movable with respect to the housing 7 and a pair of coil core portions 85, 86 fixed to the housing 7. The movable body 82 has an elongated shape extending in the X axis direction. The movable body 82 is connected to the housing 7 so that a center portion of the movable body 82 is supported by the shaft portion 81. Thus, the movable body 82 can perform reciprocating rotation with respect to the housing 7 around the shaft portion 81 (the Z axis) like a seesaw.

Magnets 83, 84 are respectively provided at both end portions of the movable body 82. The magnets 83, 84 are disposed so as to be symmetrical with each other across the shaft portion 81. The magnets 83, 84 respectively have arc-shaped magnetic pole faces 831, 841 respectively facing the coil core portions 85, 86. S poles and N poles are alternately arranged on each of the magnetic pole faces 831, 841 along its arc direction. Each of the magnets 83, 84 is a permanent magnet.

Pushers 87, 88 are provided on the movable body 82 for pushing the pump units 9 when the movable body 82 performs the reciprocating rotation around the Z axis. The pushers 87, 88 are disposed so as to be symmetrically with each other across the shaft portion 81. The pusher 87 is disposed between the shaft portion 81 and the magnet 83 so as to protrude toward both sides in a width direction of the movable body 82 (both sides of the Y axis direction). Further, the pusher 88 is disposed between the shaft portion 81 and the magnet 84 so as to protrude toward both sides in the width direction of the movable body 82 (both sides of the Y axis direction).

The coil core portions 85, 86 are respectively disposed on both X axis direction sides of the movable body 82. The coil core portion 85 faces the magnetic pole face 831 of the magnet 83. The coil core portion 86 faces the magnetic pole face 841 of the magnet 84. The coil core portions 85, 86 are disposed so as to be symmetrical with each other across the shaft portion 81.

The coil core portion 85 includes a core portion 851 and a coil 859 wound around the core portion 851. The core portion 851 has a core 852 around which the coil 859 is wound and a pair of core magnetic poles 853, 854 respectively extending from both ends of the core 852. The core magnetic poles 853, 854 respectively have magnetic pole faces 853*a*, 854*a* facing the magnetic pole face 831 of the magnet 83. Each of the magnetic pole faces 853*a*, 854*a* is curved in an arc shape so as to correspond to a shape of the magnetic pole face 831 of the magnet 83. When electric power is supplied to the coil 859 from the control device 5, the core magnetic poles 853, 854 are excited with different polarities.

The coil core portion 86 includes a core portion 861 and a coil 869 wound around the core portion 861. The core portion 861 has a core 862 around which the coil 869 is wound and a pair of core magnetic poles 863, 864 respectively extending from both ends of the core 862. The core magnetic poles 863, 864 respectively have magnetic pole faces 863*a*, 864*a* facing the magnetic pole face 841 of the magnet 84. Each of the magnetic pole faces 863*a*, 864*a* is curved in an arc shape so as to correspond to a shape of the magnetic pole face 841 of the magnet 84. When the electrical power is supplied to the coil 869 from the control device 5, the core magnetic poles 863, 864 are excited with different polarities.

The four pump units 9 are respectively disposed on an upper left side, an upper right side, a lower left side and a lower right side of the shaft portion 81. Specifically, two of the pump units 9 are disposed so as to face each other in the vertical direction (the Y axis direction) across the pusher 87. Further, remaining two of the pump units 9 are disposed so as to face each other in the vertical direction (the Y axis direction) across the pusher 88. The four pump units 9 have the same configuration as each other. Each of the pump units 9 has a sealed chamber 91 and a movable wall 92.

The sealed chamber 91 is connected to a suction port 98 for sucking the air from the outside into the sealed chamber 91 and a discharge port 99 for discharging the air in the sealed chamber 91 toward the outside. In the present embodiment, two of the sealed chambers 91 located on the upper side of the movable body 82 share one discharge port 99. Remaining two of the sealed chambers 91 located on the lower side of the movable body 82 share another discharge port 99.

The movable wall 92 constitutes a part of the sealed chamber 91. The movable wall 92 can be displaced to change a volume in the sealed chamber 91 when the movable wall 92 is pushed by the pusher 87 or 88. When the volume in the sealed chamber 91 reduces due to displacement of the movable wall 92, pressure in the sealed chamber 91 increases and thus the air in the sealed chamber 91 is discharged from the discharge port 99. On the other hand, when the volume in the sealed chamber 91 increases due to the displacement of the movable wall 92, the pressure in the sealed chamber 91 reduces and thus the air flows into the sealed chamber 91 through the suction port 98. When the above-mentioned reduction and increase of the volume in each of the sealed chambers 91 are repeated, the air is continuously discharged from the discharge ports 99. The movable walls 92 may be a diaphragm, for example. The movable wall 92 can be formed from elastically deformable material. Each of the movable walls 92 has an insertion portion 921 into which the pusher 87 or 88 should be inserted. Each of the movable walls 92 is connected to the pusher 87 or 88 through the insertion portion 921.

Valves 93 are respectively provided between the sealed chambers 91 and the suction ports 98. Each of the valves 93 allows the air to be suctioned into each of the sealed chambers 91 through the suction port 98 and prevents the air from being discharged from each of the sealed chambers 91 through the suction port 98. Further, valves 94 are respectively provided between the sealed chambers 91 and the discharge ports 99. Each of the valves 94 allows the air to be discharged from each of the sealed chambers 91 through the discharge port 99 and prevents the air from being suctioned into each of the sealed chambers 91 through the discharge port 99. With this configuration, it is possible to more reliably and more efficiently perform the suction and the discharge of the air.

The configurations of the pumps 3A, 3B have been explained in the above description. However, the configurations of the pumps 3A, 3B are not particularly limited. For example, the coil core portions 85, 86 may be provided at the movable body 82 and the magnets 83, 84 may be provided at the housing 7. Further, the magnets 83, 84 may be replaced with electromagnets. Furthermore, the number of pump units 9 may be at least one. The vibration of the movable body 82 is not limited to the reciprocating rotational vibration and may be, for example, reciprocating linear vibration as described later.

Next, the drive of the pumps 3A, 3B will be described. In the following description, the four pump units 9 are distinguished from each other by labeling them as the "pump unit 9A", the "pump unit 9B", the "pump unit 9C" and the "pump unit 9D" for convenience of explanation.

When an AC (alternating-current) voltage is applied from the drive control device 5 to the coils 859, 869, the movable body 82 performs the reciprocating rotation around the shaft portion 81 (around the Z axis). Thus, each of the pumps 3A, 3B is driven by repeatedly alternating between a first state in which the movable body 82 rotates toward one direction as shown in FIG. 4 and a second state in which the movable body 82 rotates toward another direction as shown in FIG. 5. In the first state shown in FIG. 4, the core magnetic poles 853, 864 are excited with the N pole and the core magnetic poles 854, 863 are excited with the S pole. Conversely, in the second state shown in FIG. 5, the core magnetic poles 853, 864 are excited with the S pole and the core magnetic poles 854, 863 are excited with the N pole.

In the first state, torque F1 directed toward an arrow direction illustrated in FIG. 4 is generated by magnetic force (attractive force and repulsive force) acting between the magnets 83, 84 and the coil core portions 85, 86, and thereby the movable body 82 rotates in the direction of the torque F1. With this movement, the movable walls 92 of the pump units 9A, 9D are respectively pushed by the pushers 87, 88, and thereby the volumes in the sealed chambers 91 of the pump units 9A, 9D are reduced. As a result, the air in the sealed chambers 91 of the pump units 9A, 9D is discharged from the discharge ports 99. On the other hand, since the volumes in the sealed chambers 91 of the pump units 9B, 9C increase, the air flows into the sealed chambers 91 of the pump units 9B, 9C through the suction ports 98.

In the second state, torque F2 directed toward a direction opposite to the direction of the torque F1 is generated by the magnetic force (attractive force and repulsive force) acting between the magnets 83, 84 and the coil core portions 85, 86, and thereby the movable body 82 rotates in the direction of the torque F2. With this movement, the movable walls 92 of the pump units 9B, 9C are respectively pushed by the pushers 87, 88, and thereby the volumes in the sealed chambers 91 of the pump unit 9B, 9C are reduced. As a result, the air in the sealed chambers 91 of the pump unit 9B, 9C is discharged from the discharge ports 99. On the other hand, since the volumes in the sealed chambers 91 of the pump units 9A, 9D increase, the air flows into the sealed chambers 91 of the pump units 9A, 9D through the suction ports 98.

As described above, when each of the pumps 3A, 3B repeatedly alternates between the first state and the second state, it is possible to repeatedly alternate the state in which the air is discharged from the pump units 9A, 9D and the state in which the air is discharged from the pump units 9B, 9C. As a result, the air can be continuously discharged from the pumps 3A, 3B.

The drive of the pumps 3A, 3B has been explained in the above description. Next, a driving principle of the pumps 3A, 3B will be explained. The vibration actuator 8 of each of the pumps 3A, 3B is driven according to a motion equation expressed by the following equation (1) and a circuit equation expressed by the following equation (2).

[Equation 1]

$$J\frac{d^2\theta(t)}{dt^2} = K_f i(t) - K_{sp}\theta(t) - D\frac{d\theta(t)}{dt} \tag{1}$$

J: Inertia moment [Kg*m$^2$]
θ(t): Displacement angle [rad]
$K_f$: Thrust constant [Nm/A]
i(t): Current [A]
$K_{sp}$: Spring constant [Nm/rad]
D: Damping coefficient [Nm/(rad/s)]

[Equation 2]

$$e(t) = Ri(t) + L\frac{di(t)}{dt} + K_e\frac{dx(t)}{dt} \tag{2}$$

e(t): Voltage [V]
R: Resistance [Ω]
L: Inductance [H]
$K_c$: Counter-electromotive force constant [V/(rad/s)]

As described above, the inertial moment J [Kg*m$^2$], the displacement angle (rotational angle) θ(t) [rad], the thrust constant $K_f$ [Nm/A], the current i(t) [A], the spring constant $K_{sp}$ [Nm/rad], the damping coefficient D [Nm/(rad/s)] and the like of the movable body 82 can be appropriately set as long as they satisfy the equation (1). Similarly, the voltage e(t) [V], the resistance R [Ω], the inductance L [H] and the counter-electromotive force constant $K_e$ [V/(rad/s)] can be appropriately set as long as they satisfy the equation (2).

Further, a flow rate of each of the pumps 3A, 3B is determined by the following equation (3) and pressure of each of the pumps 3A, 3B is determined by the following equation (4).

Equation 3

$$Q=Axf*60 \tag{3}$$

Q: Flow rate [L/min]
A: Piston area [m$^2$]
x: Piston displacement [m]
f: Drive frequency [Hz]

[Equation 4]

$$P = P_0\left(\frac{V+\Delta V}{V-\Delta V} - 1\right) \tag{4}$$

P: Increased pressure [kPa]
$P_0$: Atmospheric pressure [kPa]
V: Sealed chamber volume [m$^3$]
ΔV: Changed volume [m$^3$]

$$\Delta V=Ax$$

A: Piston area [m$^2$]
x: Piston displacement [m]

As described above, the flow rate Q [L/min], the piston area A [m$^2$], the piston displacement x [m], the drive frequency f [Hz] and the like of each of the pumps 3A, 3B can be appropriately set as long as they satisfy the equation (3). Similarly, the increased pressure P [kPa], the atmospheric pressure $P_0$ [kPa], the sealed chamber volume V [m$^3$], the changed volume ΔV [m3] and the like can be appropriately set as long as they satisfy the equation (4).

Next, a resonance frequency of the vibration actuator 8 of each of the pumps 3A, 3B will be explained. The vibration actuator 8 has a spring mass system structure for supporting the movable body 82 by magnetic springs formed by the magnetic force acting between the coil core portions 85, 86 and the magnets 83, 84 and air springs (fluid springs) formed by elastic force of compressed air in the sealed chambers 91. Thus, the movable body 82 has a resonant frequency $f_r$ expressed by the following equation (5). By applying an AC voltage whose frequency is substantially equal to the resonance frequency $f_r$ to the coils 859, 869 of each of the pumps 3A, 3B, it is possible to allow the movable body 82 of each of the pumps 3A, 3B to perform the resonance drive, thereby efficiently driving each of the pumps 3A, 3B.

[Equation 5]

$$f_r = \frac{1}{2\pi}\sqrt{\frac{K_{sp}}{J}} \tag{5}$$

$f_r$: Resonance frequency [Hz]

$K_{sp}$: Spiting constant [Nm/rad]

J: Inertial moment [kg*m$^2$]

The pumps 3A, 3B have been explained in the above description. As shown in FIG. 2, the pumps 3A, 3B are arranged in parallel to each other along the Y axis direction with being directed toward the same direction. Thus, vibration directions of the vibration actuators 8 of the pumps 3A, 3B coincide with each other. By arranging the pumps 3A, 3B so that the vibration directions of the vibration actuators 8 of the pumps 3A, 3B coincide with each other, it becomes easier to cancel the vibration of the vibration actuators 8 of the pumps 3A, 3B with each other or easier to superimpose the vibration of the vibration actuators 8 of the pumps 3A, 3B with each other. Thus, it is possible to drive the pump system 2 in a vibration suppression mode M1 or a vibration generation mode M2 with simple control as described later. However, arrangements of the pumps 3A, 3B are not particularly limited. For example, the pumps 3A, 3B may be arranged in parallel to each other along the X axis direction with being directed toward the same direction. Alternatively, the pumps 3A, 3B may be arranged so as to overlap each other in the Z axis direction with being directed toward the same direction.

Pipe Line 4

As shown in FIG. 2, the pipe line 4 connects the pumps 3A, 3B to the bladders 18. Specifically, the pipe line 4 includes a discharge port connection pipe line 41 for connecting the four discharge ports 99 of the pumps 3A, 3B to each other, a bladder connection pipe line 42 for connecting the two bladders 18 provided in the belt 12, an intermediate pipe line 43 for connecting the discharge port connection pipe line 41 and the bladder connection pipe line 42 and an electromagnetic valve 44 provided in the middle of the intermediate pipe line 43. Under the control of the control device 5, the electromagnetic valve 44 can switch among an open state (a first state) in which the discharge port connection pipe line 41 and the bladder connection pipe line 42 are communicated with each other, a closed state (a second state) in which a connection between the discharge port connection pipe line 41 and the bladder connection pipe line 42 is cut and a release state (a third state) in which the bladder connection pipe line 42 is closed and the discharge port connection pipe line 41 is opened to the atmosphere.

Control Device 5

The control device 6 has a function of controlling the drive of the pumps 3A, 3B and the electromagnetic valve 44. The control device 5 is composed of a computer or the like. The control device 5 has a processor for processing information, a memory communicatively connected to the processor and an external interface. In addition, the memory stores various programs which can be executed by the processor and the processor can read and execute the various programs stored in the memory for providing required functions.

Further, the control device 5 has the vibration suppression mode M1 and the vibration generation mode M2 which can be used as a drive mode for driving the pumps 3A, 3B. The vibration suppression mode M1 is a drive mode in which the pumps 3A, 3B are driven so that the vibration of the vibration actuators 8 of the pumps 3A, 3B is canceled each other and no vibration is generated from the pump system 2. On the other hand, the vibration generation mode M2 is a drive mode in which the pumps 3A, 3B are driven so that the vibration of the vibration actuators 8 of the pumps 3A, 3B are superimposed with each other, thereby generating vibration from the pump system 2. Furthermore, the vibration generation mode M2 of the control device 5 contains a first vibration generation mode M21 and a second vibration generation mode M22. An intensity and a rhythm of vibration in the first vibration generation mode M21 are different from an intensity and a rhythm of vibration in the second vibration generation mode M22.

The vibration generation mode M2 is used when the pump system 2 should be serves as notification means for notifying information to the user by using the vibration, like a vibrator. As described above, since the pump system 2 can be also used as the notifying means, it becomes unnecessary to provide any notifying means such as a vibrator separately from the pump system 2. Thus, it is possible to reduce the size of the smart watch 1, simplify the structure of the smart watch 1 and reduce the cost of the smart watch 1. In particular, since the smart watch 1 can switch between the vibration suppression mode M1 and the vibration generation mode M2, it is possible to turn on/off the vibration. Therefore, it is possible to generate the vibration only when the vibration is required.

As described above, when the pumps 3A, 3B are driven, the movable body 82 of each of the pumps 3A, 3B performs the reciprocating rotation around the shaft portion 81. As a result, the vibration corresponding to the reciprocating rotation of the movable body 82 of each of the pumps 3A, 3B generates from each of the pumps 3A, 3B. Thus, the control device 5 switches among the vibration suppression mode M1, the first vibration generation mode M21 and the second vibration generation mode M22 by changing a phase difference between the vibration of the movable body 82 of the pump 3A and the vibration of the movable body 82 of the pump 3B to cancel the two kinds of the vibration with each other or superimpose the two kinds of the vibration with each other for amplifying the two kinds of the vibration. According to the above-mentioned method, it is possible to easily and instantaneously switch among these modes.

In the vibration suppression mode M1, the drive of the pumps 3A, 3B is controlled so that the vibration generated in the pump 3A and the vibration generated in the pump 3B are counterbalanced with each other, that is, canceled each other. Specifically, the pumps 3A, 3B are respectively driven in opposite phases by respectively applying AC voltages Va, Vb, whose phases are opposite to each other (that is, shifted from each other by 180°) as shown in FIG. 6, to the pumps 3A, 3B. In the vibration suppression mode M1, when the pump 3A is in the first state, the pump 3B is in the second state. On the other hand, when the pump 3A is in the second state, the pump 3B is in the first state as shown in FIG. 7. Thus, the vibration of the pump 3A and the vibration of the pump 3B are canceled each other. As a result, the vibration of the pump system 2 is suppressed as a whole and may become zero. In this regard, the language of "opposite phases" used in the above description contains not only the case where phases are shifted from each other by 180° but also a case where the phase difference between the opposite phases varies from 180° due to an error that may occur due to some technical problems or the like.

According to the above-described vibration suppression mode M1, it is possible to drive the pump system 2 in a state that the vibration of the pump system 2 is suppressed, for instance, in a state that the vibration of the pump system 2 is not generated. Thus, the vibration suppression mode M1 is suitable for a case where the air should be supplied to the bladders 18 without generating the vibration of the pump system 2, for example.

In the first vibration generation mode M21, the drive of the pumps 3A, 3B is controlled so that the vibration generated in the pump 3A and the vibration generated in the pump 3B are superimposed with each other, that is, overlapped and amplified with each other. Specifically, the pumps 3A, 3B are driven in-phase with each other by respectively applying in-phase AC voltages Va, Vb to the pumps 3A, 3B as shown in FIG. 8. In the first vibration generation mode M21, when the pump 3A is in the first state, the pump 3B is also in the first state. Further, when the pump 3A is in the second state, the pump 3B is also in the second state as shown in FIG. 9. Thus, the vibration of the pump 3A and the vibration of the pump 3B are superimposed with each other. As a result, the vibration of the pump system 2 is generated as a whole. In particular, it is possible to generate larger vibration by driving the pumps 3A, 3B in-phase. In this regard, the language of the "in-phase" contains not only in the case where the phases for the pumps 3A, 3B are completely matched but also a case where the phase difference between the phases for the pumps 3A, 3B varies from 0° due to an error that may occur due to some technical problems or the like.

In the second vibration generation mode M22, the drive of the pumps 3A, 3B is controlled so that the vibration generated in the pump 3A and the vibration generated in the pump 3B are superimposed with each other, similarly to the first vibration generation mode M21. Specifically, the pumps 3A, 3B are respectively driven with different phases which are shifted with each other by 90° by applying different AC voltages Va, Vb whose phases are shifted from each other by 90° as shown in FIG. 10 to the pumps 3A, 3B. In the second vibration generation mode M22, when the pump 3A is in the first state, the pump 3B is in the middle of transition from the second state to the first state. When the pump 3B is in the first state, the pump 3A is in the middle of transition from the first state to the second state. When the pump 3A is in the second state, the pump 3B is in the middle of transition from the first state to the second state. When the pump 3B is in the second state, the pump 3A is in the middle of transition from the second state to the first state as shown in FIG. 11. Thus, the vibration of the pump 3A and the vibration of the pump 3B are superimposed with each other and the vibration of the pump system 2 is generated as a whole.

In the second vibration generation mode M22, since there is timing at which the two kinds of vibration are canceled each other, an intensity of the vibration of the pump system 2 generated in the second vibration generation mode M22 is weaker than an intensity of the vibration of the pump system 2 generated in the first vibration generation mode M21. Further, since timing at which the movable body 82 of the pump 3A reaches a dead center is shifted from timing at which the movable body 82 of the pump 3B reaches a dead center, a cycle of the vibration of the pump system 2 generated in the second vibration generation mode M22 is shorter than a cycle of the vibration of the pump system 2 generated in the first vibration generation mode M21. Specifically, the cycle of the vibration of the pump system 2 generated in the second vibration generation mode M22 is substantially half of the cycle of the vibration of the pump system 2 generated in the first vibration generation mode M21. In this regard, it should be noted that the phase difference between the phases for the pumps 3A, 3B in the second vibration generation mode M22 is not limited to 90° and may be appropriately changed within a range of about 90°±45°, for example.

The vibration suppression mode M1 and the vibration generation mode M2 have been explained in the above description. The control device 5 further has a pump drive mode Mp for supplying the air into the bladders 18 from the pump system 2 and a vibration drive mode Mv for vibrating the pump system 2 without supplying the air into the bladders 18 from the pump system 2. Thus, since the control device 5 has the pump drive mode Mp and the vibration drive mode Mv, the pump system 2 can be uses as not only a pump but also a vibrator. As a result, it is possible to significantly improve the convenience of the pump system 2. In this regard, the switching between the pump drive mode Mp and the vibration drive mode Mv can be performed by the drive of the electromagnetic valve 44. Thus, it is possible to easily switch between the pump drive mode Mp and the vibration drive mode Mv.

Pump Drive Mode Mp

In the pump drive mode Mp, the pump system 2 is driven so that the air is supplied into the bladders 18 from the pump system 2. Specifically, the pumps 3A, 3B are driven in a state that the electromagnetic valve 44 is in the open state as shown in FIG. 12. As a result, the air discharged from the pumps 3A, 3B is supplied into the bladders 18 to expand the bladders 18. In this pump drive mode Mp, the pumps 3A, 3B may be driven in the vibration suppression mode M1 or may be driven in the vibration generation mode M2. When the pumps 3A, 3B are driven in the vibration suppression mode M1, the pump system 2 does not generate the vibration while the air is suppled into the bladders 18. When the pumps 3A, 3B are driven in the vibration generation mode M2, the pump system 2 vibrates while the air is supplied into the bladders 18. For example, when the air supply into the bladders 18 should be notified to the user or when the user wishes to receive notification of the air supply, the pumps 3A, 3B may be driven in the vibration generation mode M2. Alternatively, when the air supply into the bladders 18 needs not to be notified to the user or when the user does not wish to receive the notification of the air supply, the pumps 3A, 3B may be driven in the vibration suppression mode M1. For example, the user can freely change settings regarding the vibration suppression mode M1 and the vibration generation mode M2.

The above-described pump drive mode Mp is mainly used when the smart watch 1 is attached to the user. Specifically, the pump drive mode Mp is used when the air is supplied to the bladders 18 to closely attach the belt 12 to the wrist of the user after the smart watch 1 is attached to the wrist of the user by the buckle 16. However, the pump drive mode Mp can be used for other applications and operations.

Vibration Drive Mode Mv

In the vibrating drive mode Mv, the pump system 2 is driven so that the air is not supplied into the bladders 18 from the pump system 2. Specifically, the pumps 3A, 3B are driven in the vibration generation mode M2 in a state that the electromagnetic valve 44 is in the release state as shown in FIG. 13. Thus, the air discharged from the pumps 3A, 3B is released to the atmosphere through the electromagnetic valve 44 and is not supplied into the bladders 18. Therefore, the function as the pump is not provided and the pump system 2 substantially serves as only the vibrator.

The above-described vibration drive mode Mv can be used for various applications such as a response to an input operation from the user, mail transmission/reception, voice call transmission/reception, video call transmission/reception, complete of electronic payment and the like.

The air released to the atmosphere through the electromagnetic valve 44 may be used for an appropriate application. Although this application is not particularly limited, it is possible to cool the components contained in the watch body 11 by blowing the released air onto the components contained in the watch body 11, for example. In addition, if the smart watch 1 has a configuration that the air is discharged to the outside of the watch body 11, it is possible to cool down the user by directing the air discharged from the watch body 11 to a face, a neck or the like of the user.

Although the pump system and the electronic device of the present disclosure have been described with reference to the illustrated embodiment, the present disclosure is not limited thereto. The configuration of each part can be replaced with any configuration having a similar function. Further, other optional component(s) may also be added to the present disclosure.

Further, although the smart watch 1 has been described as one example of the electronic device in the above-described embodiment, the electronic device is not limited thereto. For example, the present disclosure can be applied to all devices which can have the pump function and the vibrator function. Although the pump system 2 includes the pair of pumps 3A, 3B in the above-described embodiment, the pump system 2 is not limited thereto. For example, the pump system 2 may include plural pairs of pumps 3A, 3B. Further, although the movable body 82 of each of the pumps 3A, 3B can perform the reciprocating rotational vibration around the shaft portion 81 in the above-described embodiment, the present disclosure is not limited thereto. For example, the movable body 82 may be configured to perform reciprocating linear vibrate in the X axis direction as shown in FIG. 14.

Further, the configuration of the pipe line 4 is not particularly limited. For example, the pipe line 4 may contain a first pipe line 4A for connecting the pump 3A and one of the bladders 18 and a second pipe line 4B for connecting the pump 3B and the other one of the bladders 18 as shown in FIG. 15.

The invention claimed is:

1. An electronic device, comprising:

a pump system containing a pair of pumps, each of which contains a vibration actuator vibrated by an electromagnetic drive and can discharge fluid according to vibration of the vibration actuator; and a wearable supply target into which the fluid is supplied from the pump system, wherein the pump system has:

a vibration suppression mode in which the pair of the pumps are driven so that the vibration of the vibration actuators of the pair of pumps cancel each other, and a vibration generation mode in which the pair of the pumps are driven so that the vibration of the vibration actuators of the pair of pumps are superimposed on each other.

2. The electronic device as claimed in claim 1, wherein the pump system is configured to switch between the vibration suppression mode and the vibration generation mode by changing a phase difference between the vibration of the vibration actuator of one of the pair of pumps and the vibration of the vibration actuator of the other one of the pair of pumps.

3. The electronic device as claimed in claim 2, wherein the pair of pumps are arranged so that vibration directions of the vibration actuators of the pair of pumps coincide with each other.

4. The electronic device as claimed in claim 3, wherein the pair of pumps are respectively driven in opposite phases in the vibration suppression mode.

5. The electronic device as claimed in claim 3, wherein the pair of the pumps are driven in-phase in the vibration generation mode.

6. The electronic device as claimed in claim 5, wherein the vibration generation mode contains a plurality of modes whose phase differences are different from each other.

7. The electronic device as claimed in claim 1, wherein the electronic device is a wearable terminal.

8. The electronic device as claimed in claim 1, wherein the electronic device has:

a pump drive mode for supplying the fluid into the supply target from the pump system, and a vibrator drive mode for vibrating the pump system without supplying the fluid into the supply target from the pump system.

* * * * *